US007337617B2

(12) United States Patent
Anderson

(10) Patent No.: US 7,337,617 B2
(45) Date of Patent: Mar. 4, 2008

(54) REFRIGERATOR FREEZER DOOR ICE MAKER

(75) Inventor: Ronald K. Anderson, Sidney, OH (US)

(73) Assignee: Whirlpool Corporation, Benton Harbor, MI (US)

( * ) Notice: Subject to any disclaimer, the term of this patent is extended or adjusted under 35 U.S.C. 154(b) by 104 days.

(21) Appl. No.: 11/074,356

(22) Filed: Mar. 7, 2005

(65) Prior Publication Data

US 2006/0196213 A1 Sep. 7, 2006

(51) Int. Cl.
*F25C 5/18* (2006.01)

(52) U.S. Cl. ..... 62/66; 62/344

(58) Field of Classification Search ..... 62/344, 62/353

See application file for complete search history.

(56) References Cited

U.S. PATENT DOCUMENTS 3,602,007 A 8/1971 Driecl
3,747,363 A 7/1973 Grimm
4,100,761 A 7/1978 Linstromberg et al.
4,227,383 A 10/1980 Horvay
4,285,212 A * 8/1981 Prada ..... 62/344
4,306,757 A 12/1981 Horvay et al.
5,375,432 A 12/1994 Cur
6,050,097 A 4/2000 Nelson et al.
6,148,624 A * 11/2000 Bishop et al. ..... 62/137
6,425,259 B2 * 7/2002 Nelson et al. ..... 62/344
6,735,959 B1 5/2004 Najewicz
6,745,578 B2 * 6/2004 Collins et al. ..... 62/71
6,904,765 B2 * 6/2005 Lee et al. ..... 62/320
6,945,068 B2 * 9/2005 Kim et al. ..... 62/353

FOREIGN PATENT DOCUMENTS

WO WO 03/102481 A1 12/2003

* cited by examiner

*Primary Examiner*—William E. Tapolcai
(74) *Attorney, Agent, or Firm*—Michael D. Lafrenz; Kirk Goodwin

(57) ABSTRACT

An ice maker and ice bin are provided on the inside of a freezer door of a refrigerator. The ice maker is compact, and the bin is removably mounted to the door. Ice is made by the ice maker on the door, and discharged into the ice bin, which then feeds the ice to an ice dispenser when the dispenser is actuated by a person.

4 Claims, 3 Drawing Sheets

REFRIGERATOR FREEZER DOOR ICE MAKER

BACKGROUND OF THE INVENTION

Refrigerators commonly have a freezer compartment with an automatic ice maker therein. A bin is typically associated with the ice maker to receive and hold the ice until a person activates the ice dispenser. Ice making and dispensing through the freezer door are important value-added features on refrigerators.

The ice maker and ice bin normally consume premium, eye-level space in the freezer. To conserve the premium freezer space, some refrigerators have moved the ice bin to the inside of the freezer door, though the ice maker remains mounted in the freezer compartment.

Therefore, a primary objective of the present invention is the provision of an ice maker and ice bin which are mounted on the inside of the freezer door of a refrigerator so as to increase useable space in the freezer compartment.

Another objective of the present invention is the provision of a method of making ice in the freezer door, as opposed to the freezer compartment, so as to maximize freezer space.

A further objective of the present invention is the provision of a freezer door ice making system which is efficient and durable in use, and economical to manufacture.

These and other objectives will become apparent from the following description of the invention.

SUMMARY OF THE INVENTION

The refrigerator includes a freezer compartment with a door moveable between open and closed positions relative to the freezer compartment. A compact ice maker is mounted on the inside of the freezer door, along with an ice bin for receiving ice from the ice maker. The bin is in communication with an ice dispenser mounted in the door so that ice can be supplied on demand without opening the door. The bin is removably mounted to the door and includes an auger to preclude ice bridging and supply ice to the dispenser.

In the method of the invention, water is supplied to the ice maker on the freezer door so as to make ice, and ice is discharged from the ice maker into the bin on the freezer door, for subsequent dispensing through the dispenser, upon actuation by a person.

DETAILED DESCRIPTION OF THE PREFERRED EMBODIMENT

Figure 1:
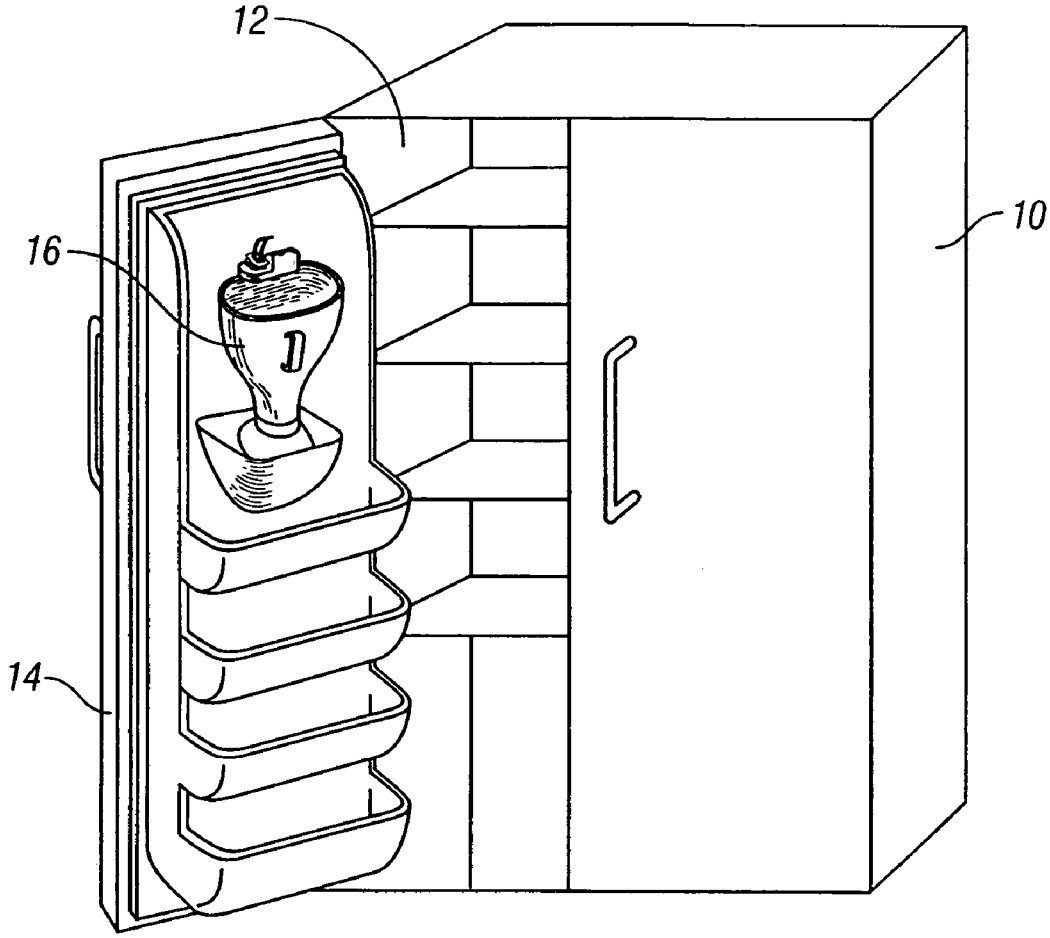
FIG. 1 is a view of a refrigerator having a freezer compartment and showing the freezer door in an open position with the ice system of the present invention.
Figure 2:
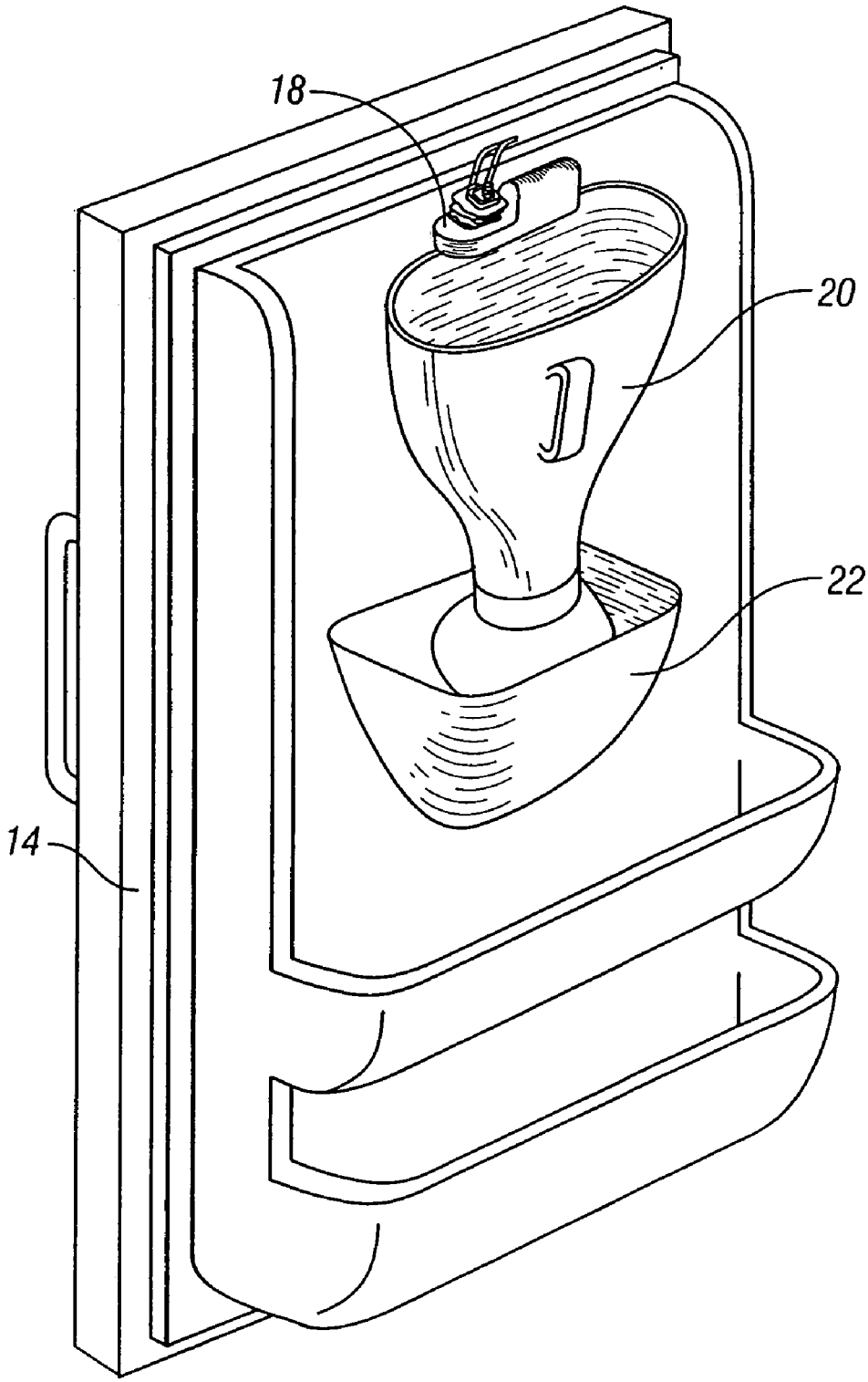
FIG. 2 is an enlarged perspective view of the inside of the freezer door with the ice maker and ice bin of the present invention.

A refrigerator is generally designated in the drawings by the reference numeral 10. The refrigerator 10 includes a freezer compartment 12, with a freezer door 14 moveable between open and closed positions relative to the freezer compartment 12. In FIG. 1, the freezer door 14 is shown in an open position.

Figure 3:
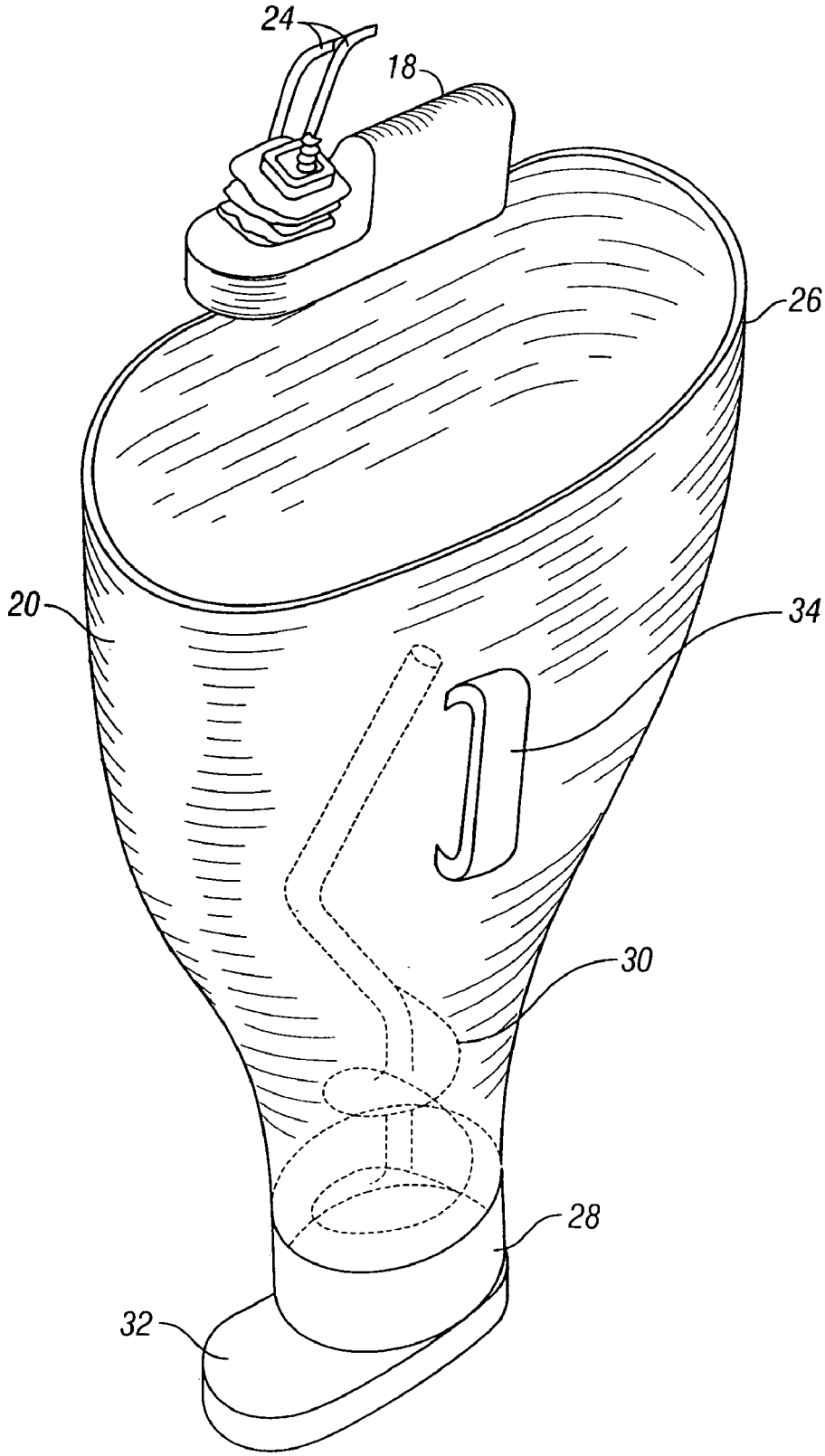
FIG. 3 is an enlarged perspective view of the ice maker and ice bin of the present invention.

The present invention is directed towards an ice making and dispensing system 16 which is mounted on the inside of the freezer door 14. The ice system 16 includes an ice maker 18, an ice bin 20 and an ice dispenser 22. As best seen in FIG. 3, one or more water lines 24 supply water to the ice maker.

Preferably, the ice maker 18 is relatively compact so as to minimize the area it occupies on the door 14, and accordingly maximize the area available on the inside of the door 14 for the ice bin 20. The ice bin 20 has an open upper end 26 which is positioned immediately beneath the outlet of the ice maker 18. The base or lower end 28 of the ice maker 18 is adjacent to and in communication with the ice dispenser 22. An auger 30 is provided in the ice maker 18 so as to break up any ice bridges which form in the bin 20. The motor (not shown) for the auger 30 is provided in the base or lower end 28 of the bin 20. The bin includes a handle 32, and is detachably mounted to the inside of the freezer door 14.

The ice dispenser 22 is conventional in construction, and supplies ice in the bin 20 to the outside of the door 14 upon demand by a person.

In the method of the present invention, water is supplied through the lines 24 to the ice maker 18 on the door 14. After ice is made, the ice maker 18 discharges the ice into the ice bin 20, which stores the ice until a person actuates the ice dispenser 22 so as to dispense ice into a glass, cup or other container on the outside of the freezer door 14.

It is understood that the dispenser 22 may be eliminated to make a lower priced refrigerator.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. In combination with a door of a freezer compartment on a refrigerator, an ice making system comprising:

a compact ice maker fixedly mounted on an interior surface of the door;

a water supply line to provide water to the ice maker;

an ice bin, wherein the length of the ice bin is greater than the width of the ice bin, and the ice bin is releasably mounted in a lengthwise direction on the inside of the door to receive ice from the ice maker;

an auger provided within the ice bin in a lengthwise direction to supply ice to the ice dispenser; and a motor provided in a base portion of the ice bin for rotating the auger, wherein the compact ice maker is adjacent to an upper end of the ice bin and is sized to occupy a small area of the total area of the upper end of the ice bin, thereby resulting in the upper end of the ice bin being substantially uncovered.

2. The combination of claim 1 further comprising an ice dispenser mounted in the door to provide ice from the bin to the outside of the door without opening the door.

3. The combination of claim 1 wherein the bin includes a handle.

4. A method of making ice in a refrigerator having a compact ice maker fixedly mounted on an inner surface of a freezer door and an ice bin releasably mounted in a lengthwise direction on an inner surface of the freezer door, wherein the compact ice maker is adjacent to an upper end of the ice bin and is sized to occupy a small area of the total area of the upper end of the ice bin, thereby resulting in the upper end of the ice bin being substantially uncovered, the method comprising the steps of:

supplying water to the ice maker so as to make ice;

discharging ice from the compact ice maker into the ice bin; and dispensing ice from the bin through the door without opening the door by rotating an auger provided within the ice bin in a lengthwise direction.

* * * * *